US009498968B2

(12) United States Patent
Tanaka

(10) Patent No.: US 9,498,968 B2
(45) Date of Patent: Nov. 22, 2016

(54) RECORDING APPARATUS

(71) Applicant: SEIKO EPSON CORPORATION, Tokyo (JP)

(72) Inventor: Yoshiyuki Tanaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/913,572

(22) PCT Filed: Aug. 22, 2014

(86) PCT No.: PCT/JP2014/004339
§ 371 (c)(1),
(2) Date: Feb. 22, 2016

(87) PCT Pub. No.: WO2015/029405
PCT Pub. Date: Mar. 5, 2015

(65) Prior Publication Data

US 2016/0207320 A1 Jul. 21, 2016

(30) Foreign Application Priority Data

Aug. 29, 2013 (JP) ..... 2013-177661

(51) Int. Cl.
*B41J 2/175* (2006.01)

(52) U.S. Cl.
CPC ..... *B41J 2/1752* (2013.01); *B41J 2/17513* (2013.01); *B41J 2002/17516* (2013.01)

(58) Field of Classification Search
CPC .. B41J 2/175; B41J 2/17501; B41J 2/17506; B41J 2/17509; B41J 2/1752; B41J 2/17513; B41J 2/17523; B41J 2002/17516
See application file for complete search history.

(56) References Cited

U.S. PATENT DOCUMENTS 5,369,429 A * 11/1994 Erickson ..... B41J 2/175 347/7
7,008,051 B2 * 3/2006 Akermalm ..... B41J 2/17509 347/85
7,370,949 B2 * 5/2008 Shiho ..... B41J 2/175 347/85

FOREIGN PATENT DOCUMENTS

JP 10-006525 A 1/1998
JP 2007-044885 A 2/2007
JP 2009-202346 A 9/2009
JP 2013-123846 A 6/2013

* cited by examiner

*Primary Examiner* — Anh T. N. Vo
(74) *Attorney, Agent, or Firm* — Workman Nydegger

(57) ABSTRACT

A recording apparatus includes an opening section 30 which is formed on an outside surface of a housing 25 and through which a sheet cassette 29 is inserted, ink containers 17*a* and 17*b* that store ink, cases 18 that are disposed on outside surfaces on both sides adjacent to an outside surface on which the opening section 30 of the housing 25 is formed and holds the ink containers 17*a* and 17*b*, and a tube that supplies the ink from ink containers 17*a* and 17*b* to the inside of the housing 25, in which sizes of the cases 18 on both sides are different from each other.

9 Claims, 6 Drawing Sheets

RECORDING APPARATUS

TECHNICAL FIELD

The present invention relates to a recording apparatus.

BACKGROUND ART

In the related art, as a type of a recording apparatus, an ink jet type printer is known in which printing is performed by ejecting ink from a recording head onto a sheet and the like. In such an ink jet type printer, in order to supply the ink continuously and stably to the printer head in a case of performing relatively large amount of printing, a configuration is proposed in which an external ink supply device (liquid supply device) is provided separately from a main device of the ink jet type printer and the ink is supplied to the printer head (for example, see PTL 1).

Such a liquid supply device includes a large-capacity ink pack (liquid container) and supplies the ink through an ink supply tube communicating the liquid supply device and the printer head inside the main device.

CITATION LIST

Patent Literature

PTL 1: Japanese Unexamined Patent Application Publication No. 2009-202346

SUMMARY OF INVENTION

Technical Problem

However, a holding section for holding the large-capacity ink pack is provided separately from the main device of the ink jet type printer. Thus, there is a problem that the ink jet type printer becomes large. Furthermore, even in a configuration in which the large-capacity ink pack is held in the main device of the ink jet type printer, if the large-capacity ink pack is disposed on one side of the main device, there is a problem that balance is poor and the main device becomes unstable.

Solution to Problem

The present invention is made to solve at least a part of the problems described above and can be realized by the following forms or application examples.

APPLICATION EXAMPLE 1

A recording apparatus of this application example includes a recording head that is capable of ejecting a liquid onto a recording medium; a recording medium holding unit that holds the recording medium; a transport unit that transports the recording medium from the recording medium holding unit to the recording head; a housing which houses the recording head and the transport unit, and into which the recording medium holding unit is inserted; and an inserting opening which is formed on an outer surface of the housing and through which the recording medium holding unit is inserted.

The recording apparatus further includes a first holding body which is disposed on an outer surface on one side adjacent to the outer surface on which the inserting opening of the housing is formed and holds a first liquid container storing the liquid; a second holding body which is disposed on an outer surface on the other side adjacent to the outer surface on which the inserting opening of the housing is formed and holds a second liquid container storing the liquid; and a supply section that supplies the liquid from the first liquid container and the second liquid container to the recording head.

Sizes of the first holding body and the second holding body are different from each other.

According to the application example, the holding bodies that are disposed on the outer surfaces on both sides adjacent to the outer surface on which the inserting opening of the housing is formed and that hold the liquid containers, and the sizes of the holding bodies on both sides are different from each other. Thus, it is possible to dispose the liquid containers of necessary sizes or the number thereof depending on a used amount different by a type of the liquid. Thus, it is possible to reduce the size of the recording apparatus. Furthermore, since liquid containers are provided on both sides of the housing, right and left weight balance is improved and the main device is prevented from being unstable.

APPLICATION EXAMPLE 2

In the recording apparatus according to Application Example 1, in the holding bodies on both sides, at least one of depths, widths, and heights thereof is different from each other.

According to the application example, the sizes of the holding bodies on both sides are different from each other.

APPLICATION EXAMPLE 3

In the recording apparatus according to Application Example 1 or 2, a size of the first holding body is smaller than a size of the second holding body.

APPLICATION EXAMPLE 4

In the recording apparatus according to Application Example 3, the number of the second liquid containers held in the second holding body is greater than the number of the first liquid containers held in the first holding body.

APPLICATION EXAMPLE 5

In the recording apparatus according to Application Example 4, a plurality of second liquid containers are held in the second holding body in a state where a part thereof is overlapped each other.

According to the application example, since the width of the second holding body can be suppressed, it is possible to improve a weight balance of the recording apparatus.

APPLICATION EXAMPLE 6

In the recording apparatus according to Application Example 4 or 5, a capacity of the first liquid container is greater than a capacity of any one of the second liquid containers.

According to the application example, it is possible to improve the weight balance of the recording apparatus with respect to the plurality of second liquid containers.

APPLICATION EXAMPLE 7

In the recording apparatus according to Application Example 6, a total capacity of the first liquid container is substantially equal to a total capacity of the second liquid container.

APPLICATION EXAMPLE 8

The recording apparatus according to any one of Application Examples 3 to 6 further includes a reading section that reads an image drawn on a document; and a transport section that transports the document to the recording section, in which the transport section is disposed on the first holding body side.

According to the application example, even if the total capacity of the first liquid container is smaller than the total capacity of the second liquid container, it is possible to improve the weight balance of the recording apparatus by the transport section having a weight.

APPLICATION EXAMPLE 9

The recording apparatus according to any one of Application Examples 1 to 8 further includes a reading section that reads an image drawn on the document mounted on a platen, in which a position of the uppermost portion of each of both the holding bodies is lower than a position of the platen.

According to the application example, operability is good when a user mounts the document on the reading section or removes the document from the reading section.

APPLICATION EXAMPLE 10

In the recording apparatus according to Application Example 2, the liquid container having a large capacity is held in the holding body of the holding bodies on both sides, of which the size is smaller than that of the other, the liquid container having a small capacity is held in the holding body having the large capacity, and the liquid containers having the number thereof greater than that of the small holding body are held in the large holding body.

According to the application example, it is possible to dispose the liquid containers of necessary sizes or the number thereof depending on a used amount different by a type of the liquid. Thus, it is possible to reduce the size of the recording apparatus.

APPLICATION EXAMPLE 11

In the recording apparatus according to Application Example 2, a same number of liquid containers are held in the holding bodies on both sides, and a capacity of at least one of the liquid containers held in the large holding body is greater than capacities of the other liquid containers.

According to the application example, it is possible to dispose the liquid containers of necessary sizes or the number thereof depending on a used amount different by a type of the liquid. Thus, it is possible to reduce the size of the recording apparatus.

APPLICATION EXAMPLE 12

In the recording apparatus according to any one of Application Examples 1, 2, and 10, in the holding bodies on both sides, the holding body of the right side holds more of the liquid containers than does the holding body of the left side in a direction in which the housing is viewed from a side on which the inserting opening is formed.

According to the application example, the operability is good when a right-handed user mounts or removes the liquid container on or from the holding body.

APPLICATION EXAMPLE 13

The recording apparatus according to any one of Application Examples 1, 2, 10 to 12, a convex section that is convex to the outside is formed on a lower portion of the holding body, and the liquid container that is held is disposed corresponding to the convex section.

According to the application example, it is possible to hold a part of the liquid container in a concave section formed on the inside of the holding body along the convex section.

APPLICATION EXAMPLE 14

In the recording apparatus according to Application Example 13, the liquid container is flexible.

According to the application example, since the liquid container is contracted depending on consumption of the liquid, it is possible to prevent the liquid from not being supplied to the recording head side by making the inside of the liquid container be a negative pressure.

APPLICATION EXAMPLE 15

In the recording apparatus according to Application Example 13 or 14, a window is formed on an upper side of the convex section.

According to the application example, the user can visually recognize the consumption of the liquid stored in the liquid container.

DESCRIPTION OF EMBODIMENTS (First Embodiment)

Hereinafter, an embodiment of a recording apparatus will be described with reference to the drawings.

Figure 1:
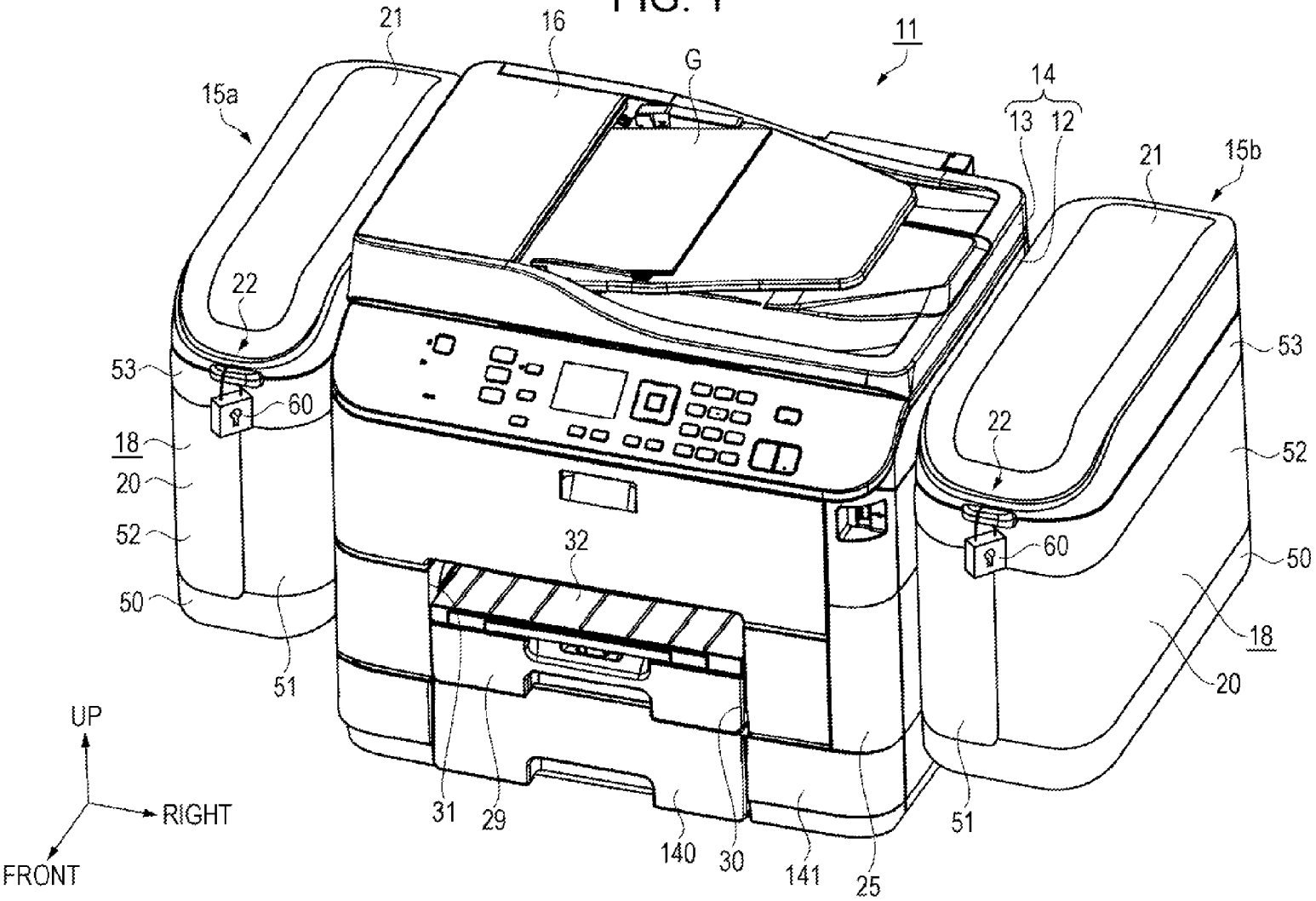
FIG. 1 is an external perspective view of a recording apparatus.

FIG. 1 is an external perspective view of an ink jet type printer (hereinafter, referred to as printer) 11 as the recording apparatus of the embodiment. The printer 11 includes a body device 14 having a printing section 12 for forming an image by ejecting ink (liquid) and a reading section 13 for reading a document G (medium), and ink supply devices 15*a* and 15*b* for supplying the ink to the printing section 12. The ink supply device 15*a* that is a first holding body is mounted on a left side of the body device 14 and the ink supply device 15*b* that is a second holding body is mounted on a right side of the body device 14.

The reading section 13 is disposed on the printing section 12. The reading section 13 is provided with a document stand (not illustrated) formed by a transparent plate member such as glass and can read the document G mounted on the document stand. Furthermore, an automatic document feeder 16 connected to an upper end portion in a rear surface of the reading section 13 through a hinge section (not illustrated) is disposed on the reading section 13. The automatic document feeder 16 can read the document G by sequentially feeding the document G on a reading window (not illustrated) formed of a transparent plate member such as glass while inverting a plurality of laminated documents G one by one. Moreover, the automatic document feeder 16 is provided with a transport section on the ink supply device 15*a* side mounted on the left side of the body device 14 from a mounting stand on which the document G is mounted. Thus, the automatic document feeder 16 has a heavy configuration on the side on which the transport section is provided.

An opening section 30 formed on a front side of a housing 25 is provided with a sheet cassette 29 detachably and insertably in forward and rearward directions, which is a recording medium holding unit. The opening section 30 is an insert opening that the sheet cassette 29 is detachably mounted on the housing 25. A discharge tray 32 is provided expandably and retractably in the forward and rearward directions on an upper side of the sheet cassette 29.

A plurality of sheets are mounted on the sheet cassette 29 in a state of being stacked. Sheets mounted on the sheet cassette 29 are supplied to the inside of the housing 25 one by one and the printed sheet is discharged from a discharge opening 31 thereby being mounted on the discharge tray 32.

An expansion cassette unit 141 is provided below the housing 25. The expansion cassette unit 141 is provided with a sheet cassette 140 that is a recording medium holding unit detachably and insertably in forward and rearward directions.

A configuration of cases 18 of the ink supply devices 15*a* and 15*b* will be described in detail. A lid 21 of the case 18 is opened on a container body 20 side, is long in the forward and rearward directions, and has a lidded rectangular box shape shallower than the container body 20. The lid 21 is connected to an upper end portion of the container body 20 on a rear surface thereof through a hinge portion (not illustrated). Thus, the lid 21 rotates around the hinge portion when being opened and closed. That is, the lid 21 is opened from the front side of the container body 20 and is closed to the front side of the container body 20.

The container body 20 includes a bottomed rectangular box-shaped bottom-wall forming member 50, a planar inner-wall forming member 51, a planar outer-wall forming member 52, and an edge member 53. The inner-wall forming member 51 has a bottomed rectangular box shape, forms an inner half (half on the body device 14 side in right and left directions) of a side wall, and is bent in a substantial U-shape. The outer-wall forming member 52 forms an outer half (half on a side opposite to the body device 14 in right and left directions) of the side wall and is bent in a substantially U-shape. The edge member 53 is hollow configuring a periphery portion of the opening section and has a rectangular frame shape.

The container body 20 is configured by combining the inner-wall forming member 51 as an example of a division member and the outer-wall forming member 52 as an example of a division member. That is, the side wall of the container body 20 is configured by combining the inner-wall forming member 51 and the outer-wall forming member 52 that are two division members.

Locking mechanisms 22 are provided on the front side of the lids 21 and the edge members 53 of the ink supply devices 15*a* and 15*b*. The locking mechanism 22 can maintain the lid 21 in a closed state with respect to the container body 20 by a so-called padlock 60.

Figure 2:
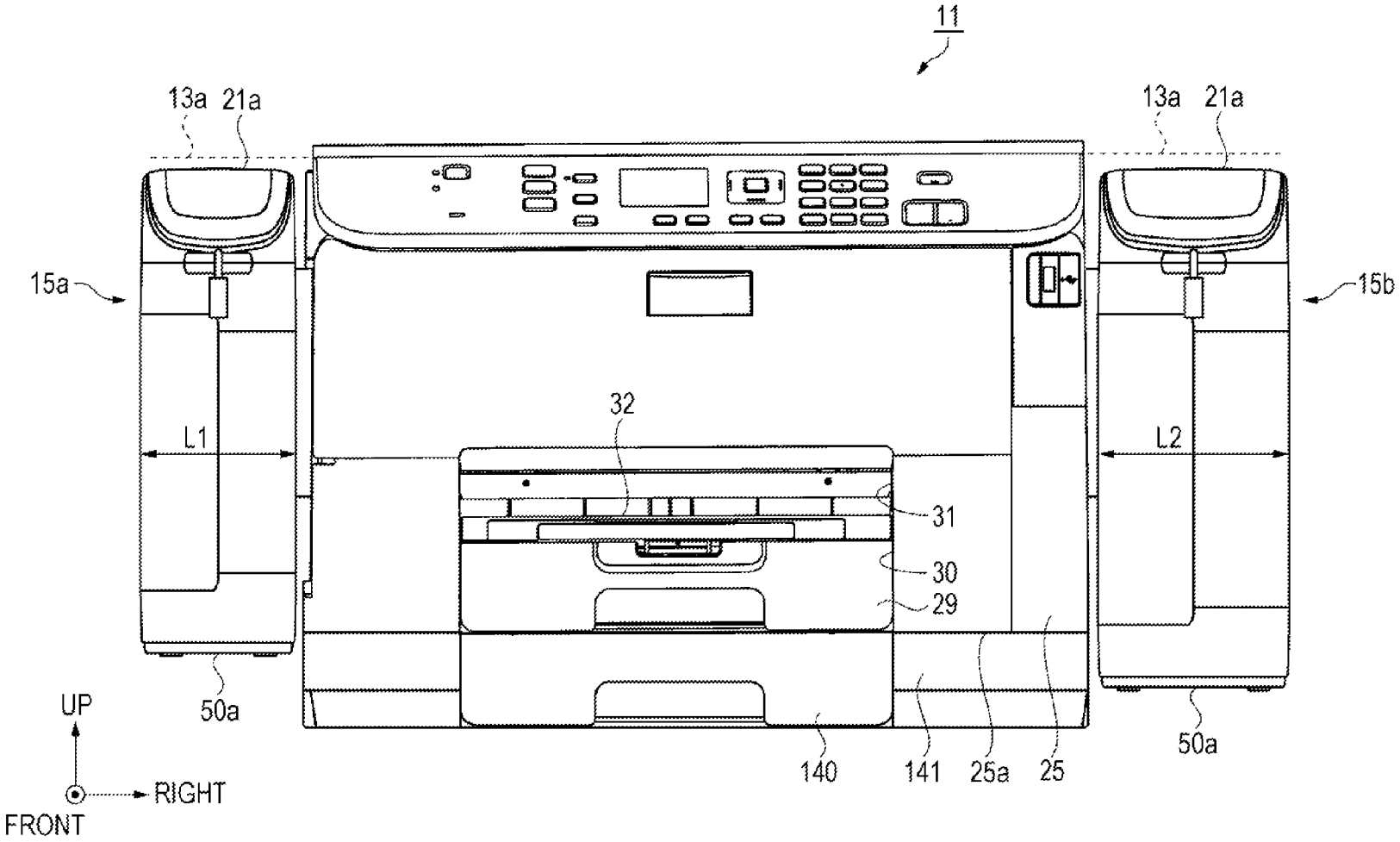
FIG. 2 is a front view of the recording apparatus in a state where an automatic document feeder is removed.

FIG. 2 is a front view of the printer 11 in a state where the automatic document feeder 16 is removed from the state of FIG. 1.

A dotted line 13*a* indicates a position of the document stand in a height direction of document stand on which the document G is mounted. Each of the ink supply devices 15*a* and 15*b* includes the lid 21 such that a position of an upper end 21*a* of the lid 21 is equal to a position 13*a* of a reading surface (document stand) in a height direction thereof or is lower than the position 13*a* in a state where the lid 21 is closed.

According to such a configuration, operability is good in an operation in which a user lifts up and rotates the automatic document feeder 16 of FIG. 1, opens the document stand, mounts the document G on the document stand, the reading section 13 reads the image of the document G, and then the user removes the document G from the document stand. Furthermore, if a size of the document G is large enough to protrude from the document stand, particularly, the document G protruding in the right and left directions of document stand is not interfered with by the ink supply devices 15*a* and 15*b* and thereby the operability is good. Furthermore, if the heights of the upper surfaces of the ink supply devices 15*a* and 15*b* are set to be substantially the same as the height of the document stand, it is possible to support the protruded document G and it is possible to prevent damage of the document G by flexing of the document G.

Figure 3:
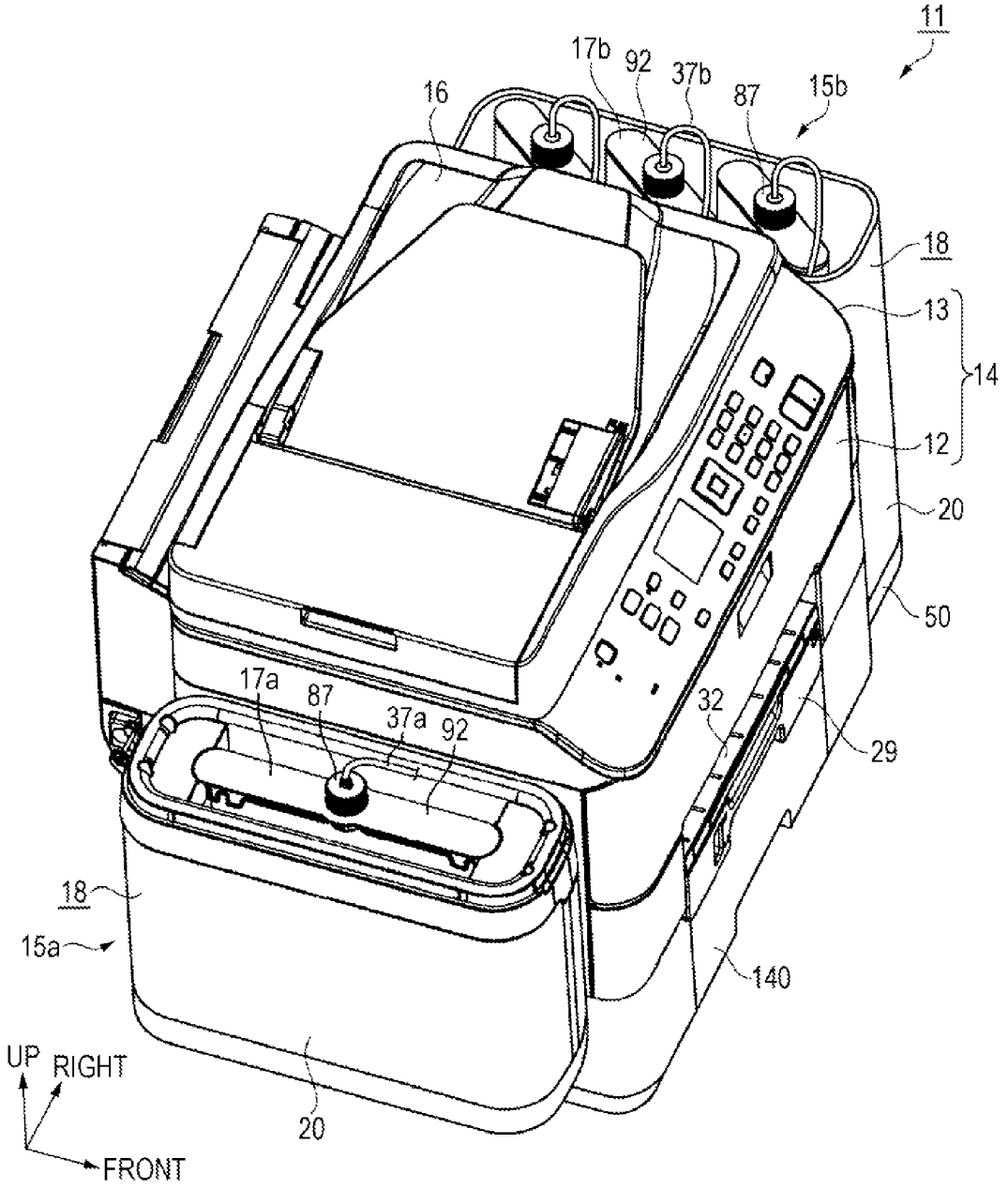
FIG. 3 is a perspective view of the recording apparatus in a state where a lid of an ink supply device is removed.

FIG. 3 is a perspective view of the printer 11 in a state where the lids 21 of the ink supply devices 15*a* and 15*b* are removed. The ink supply device 15*a* is detachably provided with one ink container 17*a* containing a monochrome ink, which is a first liquid container. The ink supply device 15*b* is detachably provided with three ink containers 17*b* containing color inks of yellow, magenta, and cyan, which are second liquid containers. An ink capacity capable of storing the ink in the ink container 17*a* is greater than an ink capacity capable of storing the ink in the ink container 17*b*. Furthermore, the ink capacities of three ink containers 17*b* are substantially the same as each other.

Furthermore, it is preferable that the ink capacity of one ink container 17*a* and a total ink capacity of three ink containers 17*b* are the same or substantially the same as each other to improve a weight balance of the printer.

Furthermore, in a case where the ink capacity of one ink container 17*a* is smaller than the total ink capacity of three ink containers 17*b*, if the transport section having a weight of the automatic document feeder 16 is disposed on the ink supply device 15*a* side holding the ink container 17*a*, it is preferable to improve the weight balance of the printer.

Figure 4:
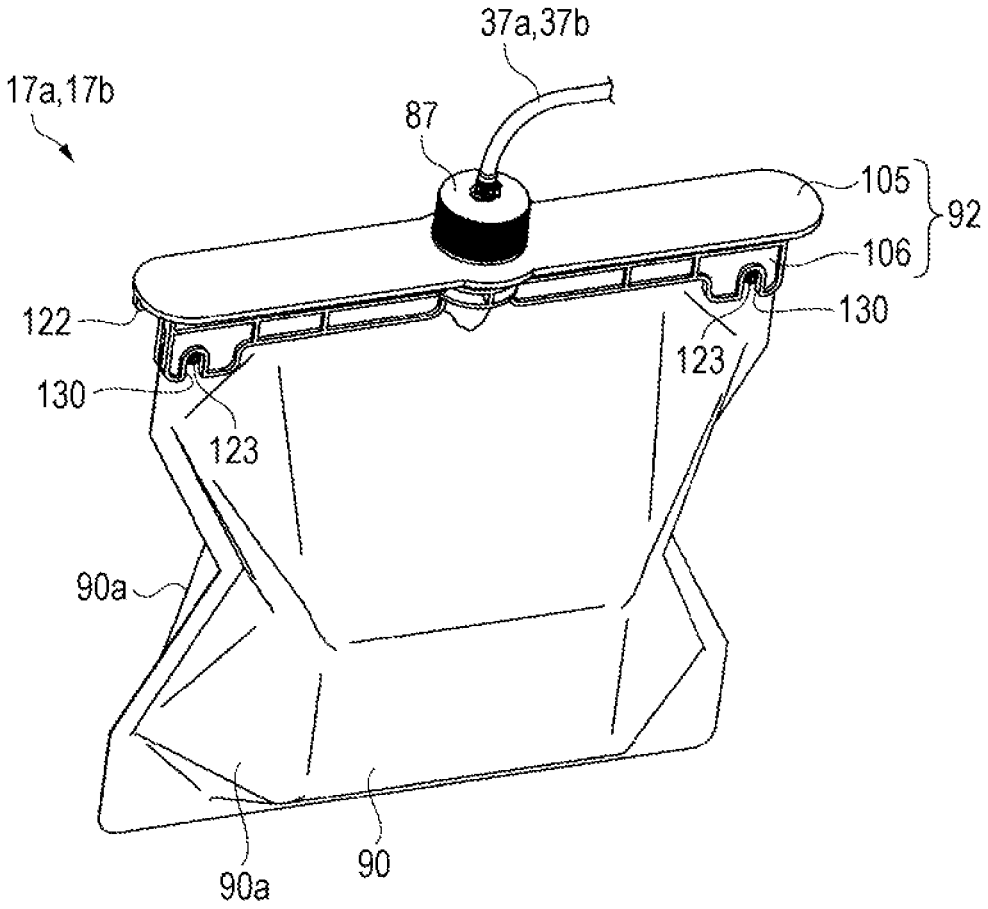
FIG. 4 is a perspective view of an ink container.

FIG. 4 is a perspective view of the ink containers 17*a* and 17*b*. Each of the ink containers 17*a* and 17*b* are provided with an ink bag 90 storing the ink. A support member (hanger member) 92 is mounted on an upper end side in the ink bag 90. That is, the ink bag 90 is engaged with the support member 92.

The ink bag 90 is formed by welding peripheral edges of two flexible films 90*a* to each other in a state where a cylindrical ink outlet portion (not illustrated) is sandwiched between the peripheral edges of the two rectangular flexible films 90*a*.

The support member 92 of each of the ink containers 17*a* and 17*b* is provided with a first support member 105 and a second support member 106 which are mounted so as to sandwich upper end portions thereof with respect to the upper end portion of the ink bag 90. Furthermore, cylindrical convex sections 123 are respectively protruded at both end portions in the second support member 106. The convex section 123 passes through an ink bag through hole (not illustrated) formed in the ink bag 90. Furthermore, the second support member 106 is provided with an engaging notched concave section 130 engaging with the convex section 123 that passes though the ink bag through hole.

Three ink containers 17*b* hold protrusion sections 122 in a concave section (not illustrated) inside the container body 20 at an angled (for example, 30 degrees) posture in which the longitudinal direction of the first support member 105 is inclined in the right and left directions. According to the configuration, since the width of the container body 20 can be suppressed, it is possible to improve the weight balance of the printer.

A valve body section (not illustrated) is provided on the upper portion of each of the ink containers 17*a* and 17*b*. The valve body section is operated by rotating a cap 87 in a pressing down direction thereof and each of connection tubes 37*a* and 37*b* is in a communication state with the inside of each of the ink containers 17*a* and 17*b*.

A length of a depth of the ink supply device 15*a* in the case 18 is shorter than a length of a depth of the ink supply device 15*b* in the case 18. Then, positions of front side end portions of the ink supply device 15*a* and the ink supply device 15*b* are substantially the same position in the forward and rearward directions, but a position of the ink supply device 15*a* on a rear surface side thereof is on a further front side than that of a rear surface side of the ink supply device 15*b*. Thus, the ink supply device 15*a* is not disposed in a left side rear surface portion of the housing 25.

The user can easily perform a connection work of a plug (not illustrated) for supplying an AC power supply connected to a power supply code to a plug receptacle (not illustrated) provided in the left side rear surface portion of the housing 25.

Furthermore, a length L1 of a width of the ink supply device 15*a* in the case 18 is shorter than a length L2 of a width of the ink supply device 15*b* in the case 18 and a length of the ink supply device 15*a* in a height direction in the case 18 is shorter than a length of the ink supply device 15*b* in the height direction in the case 18. As described above, the size of the case 18 of the ink supply device 15*a* is different from the size of the case 18 of the ink supply device 15*b*.

Figure 5:
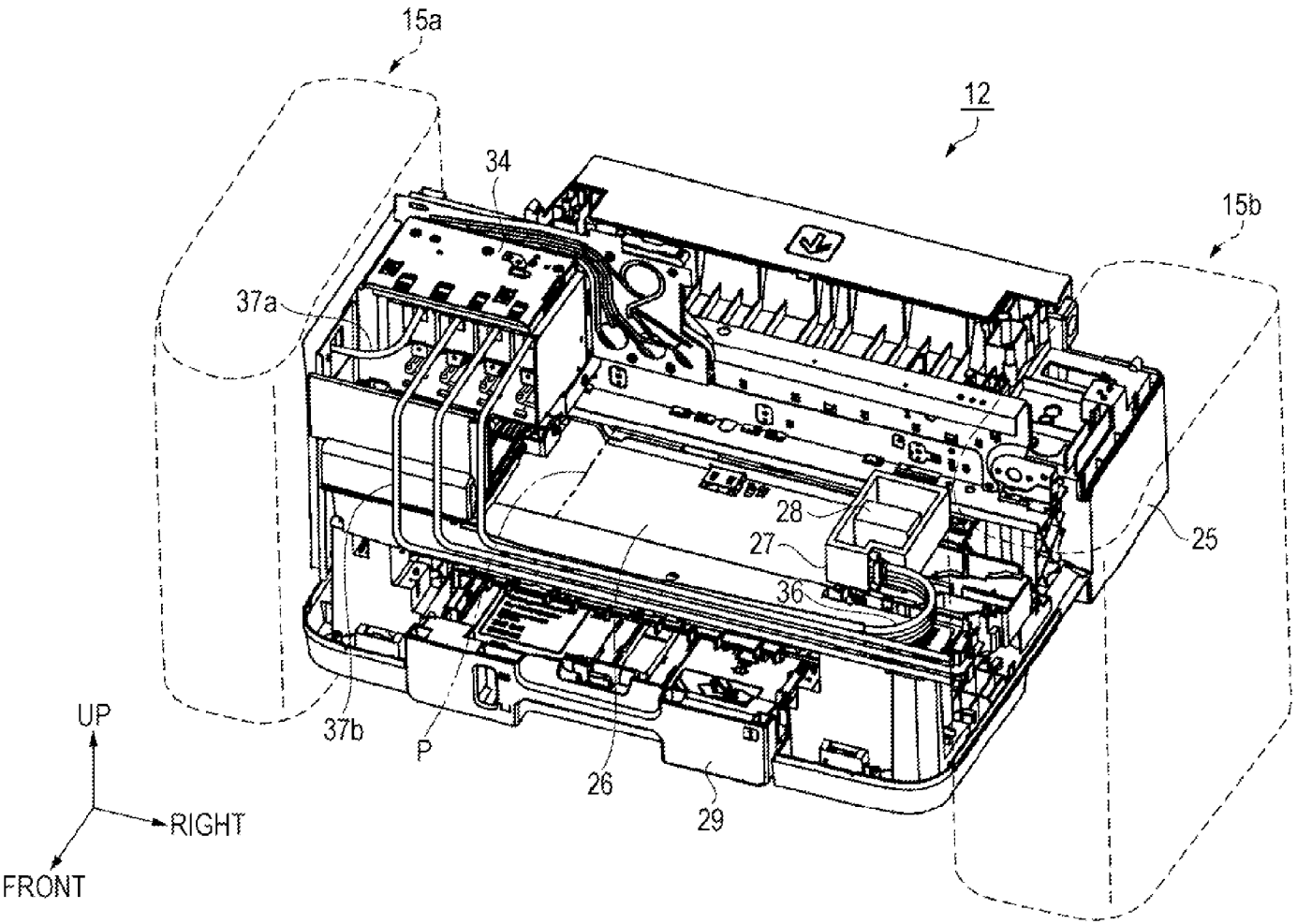
FIG. 5 is a perspective view of the recording apparatus in a state where an upper portion of a housing is removed.

FIG. 5 is a perspective view of the printer 11 in a state where the upper portion of the housing 25 is removed. The printing section 12 is provided with the substantially rectangular parallel-piped shaped housing 25 that is long in the right and left directions. A support stand 26 supporting the sheet P as the recording medium is provided in a center portion inside the housing 25. A carriage 27 capable of reciprocating in the right and left directions that is a main scanning direction is provided on an upper portion of the support stand 26.

A recording head 28 ejecting the ink is supported on the inside of the cap 27 so as to be exposed from the lower surface of the carriage 27. The recording head 28 faces the support stand 26. The recording head 28 performs printing on the sheet P by ejecting the ink from a plurality of nozzles (not illustrated) onto the sheet P transported from the rear side to the front side on the support stand 26 while the carriage 27 moves in the right and left directions.

The sheet cassette 29 is provided on the lower side of the support stand 26 in the housing 25. The sheet P inside the sheet cassette 29 is fed from the rear side to the support stand 26 while being reversed one by one by a feeding mechanism (not illustrated).

The sheet P that is printed on the support stand 26 is sequentially discharged from the discharge opening 31 of FIG. 1 configured of a region of the upper side further than the sheet cassette 29 in the opening section 30.

A rectangular box-shaped holder case 34 of which a front portion is opened is provided in a left end portion in the housing 25. Four hollow ink supply needles (not illustrated) which are lined up in the right and left directions are provided in the holder case 34.

Each ink supply needle extends in the front and rear directions and passes through a side wall of the holder case 34. A rear end portion of each ink supply needle is connected to one end side of a flexible ink supply tube 36 and the recording head 28 is connected to the other end side of the ink supply tube 36.

A front end portion of the ink supply needle is connected to one end side of one flexible connection tube 37*a* and the ink container 17*a* housed in the ink supply device 15*a* is connected to the other end side of the connection tube 37*a* (see FIG. 3).

The front end portion of each ink supply needle is connected to one end side of each of three flexible connection tubes 37*b* and each ink container 17*b* housed in the ink supply device 15*b* is connected to the other end side of connection tube 37*b* (see FIG. 3).

The valve body section (not illustrated) is provided in the upper portion of each of the ink containers 17*a* and 17*b* and the valve body section is operated by rotating the cap 87 in the pressing down direction thereof. The inside of each of the ink containers 17*a* and 17*b* is in the communication state with each of the connection tubes 37*a* and 37*b*.

Thus, the monochrome ink is supplied from the ink container 17*a* housed in the ink supply device 15*a* to the recording head 28 through the connection tube 37*a*, the ink supply needle, and the ink supply tube 36.

Furthermore, color inks of yellow ink, magenta ink, and cyan ink are respectively supplied from the ink container 17*b* housed in the ink supply device 15*b* to the recording head 28 through connection tube 37*b*, the ink supply needle, and the ink supply tube 36.

The sheet cassette 29 in the embodiment configures the recording medium holding unit, the ink containers 17*a* and 17*b* configure the liquid container, and the case 18 configures the holding body.

As described above, the printer 11 of the embodiment includes the recording head capable of ejecting the ink onto the sheet P, the sheet cassette 29 that holds the sheet P, a transport unit that transports the sheet P to the recording head, the housing 25 which contains the recording head and the transport unit, and into which the sheet cassette 29 is inserted, the insert opening (the opening section 30) which is formed on the outside surface of the housing 25 and into which the sheet cassette 29 is inserted, the ink containers 17*a* and 17*b* that store the ink, the case 18 that is disposed on the outside surface on both sides adjacent to the outside surface on which the opening section 30 of the housing 25 is formed and holds the ink container, and the supply section (including at least the connection tubes 37*a* and 37*b*) that supplies the ink from the ink container into the inside of the housing 25. Sizes of the cases 18 on both sides are different from each other.

According to the configuration, it is possible to provide the cases 18 by changing the size or the number of the ink containers 17*a* and 17*b* depending on a used amount different by a type of the ink. Thus, it is possible to reduce the size of the printer 11. Furthermore, since the ink containers 17*a* and 17*b* are provided on both sides of the housing 25, right and left weight balance is improved and the main device 14 is prevented from being unstable.

In the embodiment, in the cases 18 on the both sides, each of depths, widths, and heights are different, however, the cases of which at least one of depths, widths, and heights thereof is different from each other may be provided.

The ink container 17*a* having the large capacity is held in the case 18 of the ink supply device 15*a* that is the smaller one of the cases 18 of both sides, the ink container 17*b* having the small capacity is held in the case 18 of the ink supply device 15*b* that is the larger one of the cases 18, and the ink containers 17*b* (three) of which the number is greater than that of the ink container 17*a* (one) of the small case 18 on the left side are held in the large case 18 on the right side.

The used amount of the monochrome ink is greater than the used amount of the color ink. Thus, it is possible to dispose the ink containers 17*a* and 17*b* depending on the used amount that is different depending on the type of the ink by such a configuration.

Furthermore, the ink containers having the same number are held in the cases 18 on both sides and at least one of the ink containers that is held in the large case may have the capacity greater than those of other ink containers.

Thus, it is possible to dispose the ink containers depending on the used amount that is different depending on the type of the ink such as the monochrome ink or the color ink.

Furthermore, in the cases 18 on both sides, the case 18 of the right side holds three ink containers 17*b*, more than one ink container 17*a* of the case 18 of the left side in a direction in which the housing 25 is viewed from the side on which the inserting opening (opening section 30) is formed.

Thus, the operability is good when a right-handed user mounts or removes the ink container 17*b* on or from the case 18.

The ink containers 17*a* and 17*b* are flexible. Thus, since the ink bags 90 of the ink containers 17*a* and 17*b* are contracted depending on consumption of the ink, it is possible to prevent the inside of the ink bag 90 from being at a negative pressure and the liquid from not being supplied to the recording head 28 side.

Furthermore, since the transport sections of the automatic document feeder 16 having a weight are provided on the small ink supply device 15*a* side of both sides of the case 18, right and left weight balance is improved.

(Second Embodiment)

In the first embodiment, the case 18 in which the rotation shaft of the lid 21 is provided on the rear surface and the portion of the front side is opened is described, but in the second embodiment, a case in which a rotation shaft extending in the forward and rearward directions is provided in a lower portion of a lid 21 and a portion on the side surface side of a housing is opened is described.

Figure 6:
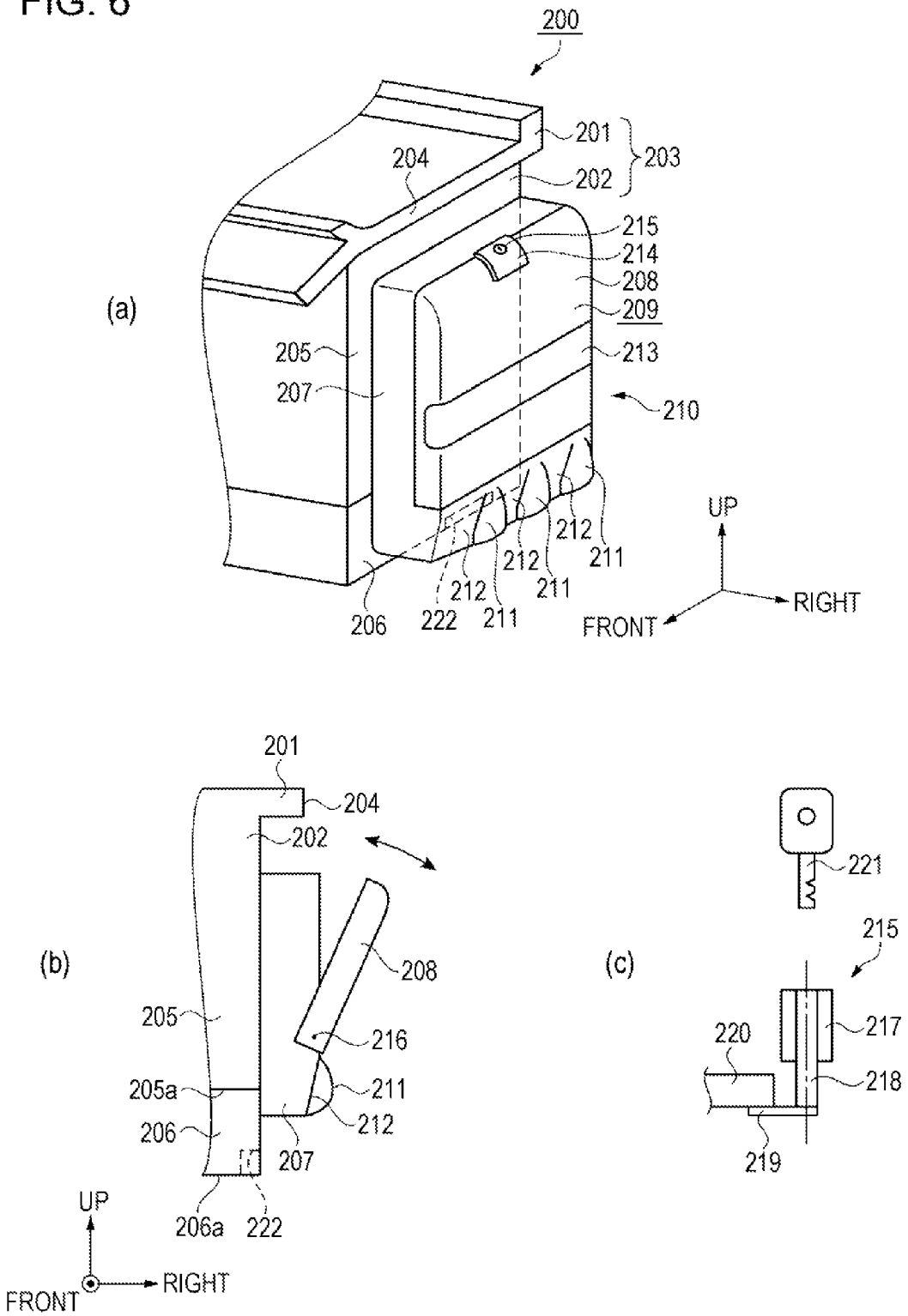
FIG. 6(*a*) is an external perspective view illustrating a portion on a side on which an ink supply device of a second embodiment is provided, FIG. 6(*b*) is a front view of the portion on the side on which the ink supply device is provided, and FIG. 6(*c*) is a view illustrating a schematic configuration of a locking mechanism.

FIG. 6(*a*) is an external perspective view illustrating a portion on a side on which an ink supply device 210 of the second embodiment is provided and FIG. 6(*b*) is a front view of the portion on the side on which the ink supply device 210 is provided. A case 209 of the ink supply device 210 is configured of a container body 207 and a lid 208.

As illustrated in FIG. 6(*b*), the lid 208 rotates in an arrow direction around a rotation shaft 216 as a support point which is provided in a lower portion in the lid 208 and of which an axial direction extends in the forward and rearward directions. Thus, a portion of the lid 208 on the right side is provided to be capable of opening.

A main device 203 is configured of a reading section 201 and a printing section 202. A visor section 204 protruding to the right side more than a wall surface of a housing 205 containing the printing section 202 is provided on the right side of the reading section 201. That is, as illustrated in FIG. 6(*b*), the visor section 204 is in a position overlapped with the container body 207 in the right and left directions. Thus, it is possible to reduce the size of a printer 200.

A thickness of the lower portion of the lid 208 is thinner than the other portions of the lid 208 and the lower portion has a tapered shape. Convex sections 211 protruding in a convex shape to the outside from the tapered side wall 212 of the lid 208 are formed in the tapered lower portion of the lid 208. A protruding amount of the convex section is equal to the other region that is not tapered. In other words, the convex section becomes a relatively protruded shape by the tapered region. Concave sections (not illustrated) formed along the shape of the convex sections 211 are formed on a wall surface of the lid 208 on the inside of the lower portion. Thus, the concave sections can hold a portion of one end side of the lower portion of the ink container (see FIG. 4) in which the container body 207 is housed.

The lid 208 is provided with a transparent member 213 having transparency. Thus, the transparent member 213 functions as a visible window through which the ink container housed in the container body 207 can be seen. Thus, it is possible to visibly recognize deflated states of all ink bags of the ink container inside the case 209 from a front side of the case 209 from the outside of the transparent member 213. Thus, it is possible to recognize an exchange time of the ink container from the deflated state of the ink bag 90 of each ink container.

The lid 208 of FIG. 6(*a*) is provided with an opening and closing lever 214 that is used when opening and closing the lid 208. The opening and closing lever 214 is provided at a position between a plurality of ink containers housed in the container body 207. A locking mechanism or a structure such as a hook (not illustrated) is provided in the opening and closing lever 214 to fix the container body 207 and the lid 208 in a closed state. An installation space thereof is necessary. Even in such a case, it is possible to shorten the length of the width of the case 209 by providing the opening and closing lever 214 at the position between the plurality of ink containers housed in the container body 207.

The lid 208 and the container body 207 are provided with a locking mechanism 215 capable of maintaining the lid 208 in the closed state. FIG. 6(*c*) is a view illustrating a schematic configuration of the locking mechanism 215. The locking mechanism 215 is configured of a so-called cylinder lock.

A holding member 217 is provided in an upper portion of the lid 208. A rotation member 218 is rotatably provided in the holding member 217. A lever 219 is provided at an end portion of the rotation member 218. When a user inserts a key 221 into the opening section of the rotation member 218 and rotates the key 221, the lever 219 is rotated and engages with an engaging section 220 provided in the container body 207, and the lid 208 becomes in the closed state with respect to the container body 207.

An expansion cassette unit 206 is provided below the housing 205 separately from a sheet cassette (not illustrated) provided to be capable of being inserted into and being removed from an inserting opening of the housing 205. A lower end portion of the case 209 is positioned below a bottom portion 205*a* of the housing 205 and a lower end portion of the case 209 is positioned above a bottom portion 206*a* of the expansion cassette unit 206.

A concave handle section 222 is provided long in the forward and rearward directions is provided in a corner portion of the bottom portion 206*a* of the expansion cassette unit 206 on the right side. The handle section 222 is provided in a position in which the lid 208 and the container body 207 are not overlapped in the upward and downward directions. In a state where the ink supply device 210 is mounted on the housing 205, the user grips the handle section 222 and in a state where the expansion cassette unit 206 and the main device 203 mounted on the expansion cassette unit 206 are held, the user can lift up and move the printer 200. Furthermore, the handle section 222 is clearly shown and thereby it is possible to prevent erroneously hold the ink supply devices 15*a* and 15*b* and damage the ink supply devices 15*a* and 15*b* when moving the printer 200.

REFERENCE SIGNS LIST

11, 200 . . . ink jet type printer, 13, 201 . . . reading section, 17*a*, 17*b* . . . ink container, 18, 209 . . . case, 25, 205 . . . housing, 28 . . . recording head, 29, 140 . . . sheet cassette, 30 . . . opening section, 37*a*, 37*b* . . . connection tube, 90*a* . . . flexible film, 211 . . . convex section, 213 . . . transparent member, L1, L2 . . . length of width.

The invention claimed is:

1. A recording apparatus comprising:

a recording head that is capable of ejecting a liquid onto a recording medium;

a recording medium holding unit that holds the recording medium;

a transport unit that transports the recording medium from the recording medium holding unit to the recording head;

a housing which houses the recording head and the transport unit, and into which the recording medium holding unit is inserted;

an inserting opening which is formed on an outer surface of the housing and through which the recording medium holding unit is inserted;

a first holding body that is disposed on an outer surface on one side adjacent to the outer surface on which the inserting opening of the housing is formed and holds a first liquid container storing the liquid;

a second holding body that is disposed on an outer surface on the other side adjacent to the outer surface on which the inserting opening of the housing is formed and holds a second liquid container storing the liquid; and a supply section that supplies the liquid from the first liquid container and the second liquid container to the recording head of the housing, wherein the number of the second liquid containers held in the second holding body is greater than the number of the first liquid containers held in the first holding body.

2. The recording apparatus according to claim 1, wherein a capacity of the first liquid container is greater than a capacity of the second liquid container.

3. The recording apparatus according to claim 2, wherein in the holding bodies on both sides, at least one of depths, widths, and heights thereof is different from each other.

4. The recording apparatus according to claim 3, wherein a plurality of second liquid containers are held in the second holding body in a state where a part thereof is overlapped each other.

5. The recording apparatus according to claim 4, wherein the first liquid container has a first ink bag storing the ink and a first hanger member mounted on an upper end side in the first ink bag, the first liquid container is hold on the first holding body by the first hanger member, wherein the second liquid container has a second ink bag storing the ink and a second hanger member mounted on an upper end side in the second ink bag, the second liquid container is hold on the second holding body by the second hanger member.

6. The recording apparatus according to claim 1, wherein a capacity of the first liquid container is greater than a capacity of any one of the second liquid containers.

7. The recording apparatus according to claim 6, wherein a total capacity of the first liquid container is substantially equal to a total capacities of the plurality of second liquid containers.

8. The recording apparatus according to claim 1, further comprising:

a reading section that reads an image drawn on a document; and a transport section that transports the document to the recording section, wherein the transport section is disposed on the first holding body side.

9. The recording apparatus according to claim 1, further comprising:

a reading section that reads an image drawn on the document mounted on a reading surface, wherein a position of the uppermost portion of each of the first holding body and the second holding body is lower than a position of the reading surface.

* * * * *